US008666681B2

(12) United States Patent
Noda et al.

(10) Patent No.: US 8,666,681 B2
(45) Date of Patent: Mar. 4, 2014

(54) MASS ANALYSIS DATA ANALYZING METHOD AND MASS ANALYSIS DATA ANALYZING APPARATUS

(75) Inventors: Akira Noda, Kyoto (JP); Yoshikatsu Umemura, Mishima-gun (JP)

(73) Assignee: Shimadzu Corporation, Kyoto-Shi (JP)

( * ) Notice: Subject to any disclaimer, the term of this patent is extended or adjusted under 35 U.S.C. 154(b) by 365 days.

(21) Appl. No.: 12/995,459

(22) PCT Filed: Jun. 4, 2008

(86) PCT No.: PCT/JP2008/001411

§ 371 (c)(1),
(2), (4) Date: Jan. 4, 2011

(87) PCT Pub. No.: WO2009/147699

PCT Pub. Date: Dec. 10, 2009

(65) Prior Publication Data

US 2011/0125416 A1 May 26, 2011

(51) Int. Cl.
*G06F 19/00* (2011.01)

(52) U.S. Cl.
USPC ..... 702/30; 250/281

(58) Field of Classification Search
USPC ..... 250/390.01, 390.07; 702/30; 506/5
See application file for complete search history.

(56) References Cited

U.S. PATENT DOCUMENTS 5,130,538 A 7/1992 Fenn et al. ..... 250/282
6,104,027 A * 8/2000 Gee et al. ..... 250/282

(Continued)

FOREIGN PATENT DOCUMENTS

JP 6-124686 5/1994
JP 2004-132946 4/2004
JP 2004-271185 9/2004
WO WO 2006/120928 A1 11/2006

OTHER PUBLICATIONS

Mann et al., "Interpreting Mass Spectra of Multiply Charged Ions" Analytical Chemistry, vol. 61, No. 15, pp. 1702-1708, Aug. 1, 1989.

(Continued)

*Primary Examiner* — Sujoy Kundu
*Assistant Examiner* — Corey Bailey
(74) *Attorney, Agent, or Firm* — Bingham McCutchen LLP

(57) ABSTRACT

The present invention aims at providing a method and apparatus for analyzing a mass spectrum on which multivalent ion peaks originating from a target compound appear, and calculating the mass of the target compound. First, each peak on the mass spectrum is analyzed to detect isotopic clusters, and the valence and the representative point (m/z value) of each isotopic cluster are obtained (S1 through S3). Since the range of the m/z value of the component which is added to or desorbed from the compound is limited, by using this factor, the isotopic clusters originating from the same compound are deduced. By combining the deduced isotopic clusters, the candidates for the m/z value of the added/desorbed component are deduced (S5). Among the plurality of selected candidates, clearly abnormal candidates are eliminated by using a plurality of conditions such as the degree of distribution of the m/z values and the similarity of the relative intensities of the representative points of the isotopic clusters (S6 through S9). The candidate having the smallest distribution of m/z values or the candidate having the highest similarity of the relative intensities of the representative points is finally selected. After the m/z value of the added/desorbed component is determined, the mass of the compound is calculated (S10 through S16).

11 Claims, 5 Drawing Sheets

(56) References Cited

U.S. PATENT DOCUMENTS

| | | | | |
|---|---|---|---|---|
| 6,188,064 | B1 * | 2/2001 | Koster | 250/282 |
| 6,745,133 | B2 * | 6/2004 | Axelsson | 702/27 |
| 6,747,272 | B2 * | 6/2004 | Takahashi | 250/282 |
| 7,117,103 | B2 * | 10/2006 | Szelewski et al. | 702/30 |
| 2003/0213902 | A1 | 11/2003 | Takahashi | 250/282 |
| 2004/0181351 | A1 * | 9/2004 | Thompson et al. | 702/76 |
| 2009/0026360 | A1 * | 1/2009 | Yamauchi et al. | 250/281 |

OTHER PUBLICATIONS

Extended European search reported Jul. 20, 2012 issued in corresponding European application 0876408.2.

Chinese language office action dated Jul. 20, 2012 and its English language translation issued in corresponding Chinese application 200880129663.6.

Japanese language office action dated Jan. 22, 2013 and its English language translation issued in corresponding Japanese application 2010515670.

Chinese Office Action dated Mar. 21, 2013 for corresponding Chinese Patent Application No. 200880129663.6, English translation of "Reason for Rejection".

"(Technical Classification) 2-4-1-4 General Techniques of Mass Analysis / Data Processing / Spectrum Processing / Deconvolution," Search Date May 1, 2010, <http://www.jpo.go.jp/shiryou/s_sonata/hyoujun_gijutsu/mass/2-4-1.pdf>.

Japanese language international preliminary report on patentability dated Jan. 11, 2011 and its English language translation for corresponding PCT application PCT/JP2008/001411.

Chinese Office Action dated Sep. 17, 2013 for corresponding Chinese Patent App. No. 200880129663.6.

English translation of "Reason for Rejection" in Chinese Office Action dated Sep. 17, 2013 for corresponding Chinese Patent App. No. 200880129663.6.

* cited by examiner

MASS ANALYSIS DATA ANALYZING METHOD AND MASS ANALYSIS DATA ANALYZING APPARATUS

CROSS-REFERENCE TO THE RELATED APPLICATIONS

This application is a national stage of international application No. PCT/JP2008/001411, filed on Jun. 4, 2008, the entire contents of which are incorporated herein by reference.

TECHNICAL FIELD

The present invention relates to a mass analysis data analyzing method and a mass analysis data analyzing apparatus for analyzing and processing mass spectrum data collected by a mass analysis. More particularly, it relates to a mass analysis data analyzing method and a mass analysis data analyzing apparatus for analyzing and processing mass spectrum on which peaks originating from a multivalent ion or ions having two or more electric charges appear to obtain the molecular weight of a target compound or identify the target compound.

BACKGROUND ART

An atmospheric pressure ionization interface is used to ionize and mass analyze a liquid sample or components to be analyzed in an eluate which have been separated by a liquid chromatograph. Typical and known atmospheric pressure ionization methods include an electro spray ionization (ESI) method and an atmospheric pressure chemical ionization (APCI) method. Generally, such an atmospheric pressure ionization interface is often used in combination with a quadrupole mass spectrometer, an ion trap mass spectrometer, or a time-of-flight mass spectrometer.

A characteristic of an atmospheric pressure ionization interface, particularly an ESI interface, is that it tends to generate a multivalent ion or ions having a plurality of electric charges in the ionization process of a target compound. A multivalent ion is advantageous that the range of the m/z values to be analyzed can be restricted to a relatively low range since the m/z value of a multivalent ion becomes smaller according to its valence than the molecular weight of its original compound. In particular, in analyzing a compound having a large molecular weight such as a protein or a peptide, despite that the m/z value of a monovalent ion can exceed the measurable range of a mass spectrometer, the use of a multivalent ion can bring the m/z value to the measurable range of the mass spectrometer. Therefore, a mass analysis using a multivalent ion is very effective in identifying a compound having a large molecular weight.

Naturally, in mass analyzing a compound having a large molecular weight, peaks originating from ions of a variety of valences appear on a mass spectrum. Also, in analyzing a sample in which various kinds of compounds are mixed, peaks originating from the respective compounds are mixed on the mass spectrum. Hence, the data analysis for such a mass spectrum is complicated. The method of separating and extracting the peak of the target compound from a mass spectrum on which a plurality of multivalent ion peaks are observed and then obtaining its m/z value is called deconvolution (refer to Non-Patent Document 1 and other documents).

In the course of an ionization by the ESI method or other method, a variety of ions are added to or desorbed from the target compound to generate a multivalent ion or ions. For example, in a cation measurement mode, other than a proton-added ion in which one proton ($H^+$) has been added to the target compound, adduct ions can be detected in which a variety of components such as ions existing in the mobile phase used in a liquid chromatograph and ions from the metal of the piping, e.g. sodium (Na), ammonia ($NH_4$), or both a proton and methanol, are added to the target compound. Meanwhile, in an anion measurement mode, in addition to a proton-desorbed ion, in which one proton has been desorbed from the target compound, adduct ions are detected in which the components of acetic acid ($CH_3COOH$), formic acid (HCOOH), or other element in the mobile phase are added to the target compound.

Adduct ions having the same valence may have different m/z values due to the substance which has been added to or desorbed from the target compound. Therefore, in order to perform a deconvolution process to a mass spectrum on which peaks of a multivalent ion or ions appear, it is necessary to determine what component has been added to or desorbed from the target compound. For this purpose, conventionally a deconvolution process as described in Patent Document 1 and other documents has been performed in the following procedure. First, before performing an analysis operation, a user enters the kind of the component (or ion) which is added to or desorbed from the target compound in the ionization process. In response to this input, a data analysis processor collects a plurality of peaks originating from components having the same mass M, by using the fact that the m/z values of the peaks of the multivalent ions observed on a mass spectrum present an orderly series in which the relation (M/n)−A, i.e. the combination of n and M, always holds, where n is a natural number, A is the mass (or m/z value) of the added ion, and M is the mass of the target compound.

However, the kind and the tendency of occurrence of an ion addition reaction or an ion desorption reaction with a compound as previously described vary depending on the properties of the compound, the conditions of the ionization, and other factors. Further, controlling such an ion addition reaction or ion desorption reaction is difficult. Therefore, knowing beforehand what kind of adduct ions will be detected is a considerably difficult task. Since such a task requires a compilation of knowledge and experience, such an analytical operation is usually assigned to an analysis operator having a high skill, and the problem is that a person who has a limited knowledge or experience cannot perform an accurate analysis. In addition, even when a skilled analysis operator performs an analytical operation, a certain amount of trial-and-error operation is required, which disadvantageously elongates the operation and decreases the throughput.

Furthermore, in analyzing a sample in which a variety of compounds are mixed, a large number of peaks originating from the plurality of compounds are observed on the mass spectrum. This might inadvertently cause an incorrect setting of valence n, leading to an incorrect final mass calculation.

[Patent Document 1] U.S. Pat. No. 5,130,538

[Non-Patent Document 1] "(Technical Classification) 2-4-1-4 General Techniques of Mass Analysis/Data Processing/Spectrum Processing/Deconvolution," (online), Japanese Patent Office, (Search Date: May 1, 2010), Internet <http://www.jpo.go.jp/shiryou/s_sonota/hyoujun_gijutsu/mass/2-4-1.pdf>

DISCLOSURE OF THE INVENTION

Problems to be Solved by the Invention

The present invention has been accomplished to solve the aforementioned problems and the objective thereof is to provide a mass analysis data analyzing method and a mass analysis data analyzing apparatus which enable a person who has a limited chemical knowledge or experience in analysis to specify and identify the mass of a target compound accurately and efficiently, by saving the work of the user to deduce the component which is added or desorbed in ionizing the target compound.

Means for Solving the Problems

To solve the previously described problems, the first aspect of the present invention provides a mass analysis data analyzing method for obtaining a mass of a target compound by analyzing data of a mass spectrum obtained by a mass analysis on which peaks of a multivalent ion appear, including:

a) a valence deduction step for detecting isotopic clusters on the mass spectrum and for deducing the valence of each of the isotopic clusters;

b) a representative point determination step for obtaining the m/z value which represents each of the detected isotopic cluster;

c) a candidate extraction step for obtaining candidates for the m/z value of a component which has been added to the target compound or desorbed from the target compound in an ionization process, based on the combination of representative points and valences of two or more isotopic clusters which are deduced to originate from the same target compound;

d) an added/desorbed component selection step for evaluating, for the plurality of candidates obtained from different combinations of the plurality of isotopic clusters, the validity of the combination of the candidate m/z values or the isotopic clusters which were the basis of the calculation of the m/z values to finally select one candidate; and e) a compound deduction step for deducing the mass of the target compound based on the m/z value and the valence of the selected added/desorbed component.

The second aspect of the present invention, which is an embodied form of the mass analysis data analyzing method according to the first aspect of the present invention, provides a mass analysis data analyzing apparatus for obtaining a mass of a target compound by analyzing data of a mass spectrum obtained by a mass analysis on which peaks of a monovalent ion appear, including:

a) a valence deduction means for detecting isotopic clusters on the mass spectrum and for deducing the valence of each of the detected isotopic cluster;

b) a representative point determination means for obtaining an m/z value which represents each of the detected isotopic cluster;

c) a candidate extraction means for obtaining candidates for the m/z value of the component which has been added to the target compound or desorbed from the target compound in an ionization process, based on the combination of representative points and valences of two or more isotopic clusters which are deduced to originate from the same target compound;

d) an added/desorbed component selection means for evaluating, for the plurality of candidates obtained from different combinations of the plurality of isotopic clusters, the validity of the combination of the candidate m/z values or the isotopic clusters which were the basis of the calculation of the m/z values to finally select one candidate; and e) a compound deduction means for deducing the mass of the target compound based on the m/z value and the valence of the selected added/desorbed component.

The mass analysis data analyzing method according to the first aspect of the present invention may be described as a program which is executed on a computer to realize the mass analysis data analyzing apparatus according to the second aspect of the present invention.

The mass spectrometer used in this invention is required to have a high mass resolution and mass accuracy. In particular, the resolution and accuracy are required to be high enough that a plurality of isotopic peaks composing an isotopic cluster can be sufficiently observed. Taking into account this requirement, a time-of-flight mass separator (TOF-MS) may be typically used as a mass separator.

As the ion source of the mass spectrometer, an atmospheric pressure ion source, typically an electrospray ionization ion source, is used since a mass spectrum on which peaks of a multivalent ion or ions appear can be easily obtained.

In the mass analysis data analyzing method according to the first aspect of the present invention which has an embodied form of the analysis data analyzing apparatus according to the second aspect of the present invention, the method that the applicant of the present invention suggests in the document of International Application No. PCT/JP2006/308909 (International Publication No. WO2006/120928) can be used to detect isotopic clusters on a mass spectrum. That is, centroid data is first created which shows each peak on a mass spectrum with two values: an m/z value, which shows the centroid of the peak, and the area value of the peak. Then, by using the emerging pattern of the peaks on the mass spectrum, isotopic clusters in the mass spectrum are detected and the valence is simultaneously deduced from the intervals of the plurality of peaks composing the isotopic clusters.

In the case where the sample includes a single compound, peaks of the multivalent ion or ions originating from this single compound appear on the mass spectrum. Hence, a plurality of isotopic clusters with different valences originating from a single compound are detected. Meanwhile, in the case where the sample is a mixture of a plurality of compounds, peaks of the multivalent ions originating from each compound appear on the mass spectrum. Since isotopic clusters with different valences can exist for each of the plurality of compounds, the mass spectrum is more complicated than the case of a single compound.

In the representative point determination step, the m/z value of the representative point is determined for each of the isotopic clusters. It is known that isotopic clusters which are composed of the same substance show the substantially same distribution profile even though they have different valences. Given this factor, in general, the peak at the forefront of an isotopic cluster or the peak having the highest intensity is often selected as the representative point. However, the peak appearing at the forefront of an isotopic cluster with a large molecular weight might have a low intensity to be buried in the noise. Hence, it could be that not the foremost but the second peak is selected. Regarding the peak having the highest intensity, if the peak having the highest intensity and that having the second highest intensity are close, it is very likely that these two peaks interchange with each other. Given these factors, as a preferable embodiment, the m/z value of the centroid of the plurality of peaks may be set as the representative point in order to stably obtain the representative point. Alternatively, the m/z value of a monoisotopic ion can be used. In this manner, the valence and the representative point of each of the isotopic clusters are determined.

Multivalent ions originating from the same compound can be supposed to be an ion which has been generated by the process in which the same component has added to or desorbed from the compound. Of course, other component or components can be added to or desorbed from a different compound to generate a multivalent ion or ions. Since the kind of the components which is added to or desorbed from a component to generate an adduct ion can be estimated to some extent and the m/z value is not that large, the range of possible m/z value can be limited.

In the candidate extraction step, based on the valence and representative point of each of many isotopic clusters, two or more isotopic clusters which are deduced to originate from the same component are extracted by taking into account the range of the m/z value which the added/desorbed component can take. Then, based on the combinations of these isotopic clusters, m/z values of the added/desorbed component are calculated, and the calculation results are set to be candidate m/z values for the added/desorbed component. Combining isotopic clusters which are deduced to originate from the same compound does not always give the same candidate m/z value due to the mass error, mischoice of the selected peak, and other factors. In general, the more the number of multivalent ions having different valences is, the more the number of candidates is obtained.

In the added/desorbed component selection step, the validity of each of the plurality of candidates for the added/desorbed component is evaluated to select one candidate. In performing this selection, a plurality of criteria for evaluation can be used. For example, based on a criterion for evaluation, a candidate or candidates which are deduced to be clearly abnormal may be excluded and then another criterion for evaluation may be applied to the remaining candidates to select the most appropriate candidate.

In a specific example, by applying a statistical method to the plurality of candidate m/z values, a candidate having a high validity may be selected or a candidate or candidates having a low validity may be excluded. In the statistical method, for example, based on the degrees of dispersion of the plurality of candidate m/z values, a candidate having a small degree of dispersion is determined to have a high validity.

Even if two or more isotopic clusters have different valences, if a plurality of peaks originating from the same compound exist, the ratio of the relative intensity of their representative points has a strong correlation. Hence, the similarity of intensity ratios of the representative points or peaks closest thereto of different valences on the mass spectrum may be evaluated to evaluate the validity of the combination of the isotopic clusters and a candidate having a high validity may be selected or a candidate or candidates having a low validity may be excluded.

After the m/z value of the added/desorbed component is determined as previously described, in the compound deduction step, the mass of the target compound is deduced based on the m/z value of the added/desorbed component and the valance and the representative point of the isotopic cluster which were the basis of the m/z value to identify the target compound.

Effects of the Invention

With the mass analysis data analyzing method according to the first aspect of the present invention and the mass analysis data analyzing apparatus according to the second aspect of the present invention, a user does not have to enter the information on the component which is added to or desorbed from the target compound in the ionization process, and the most appropriate added/desorbed component is automatically found. Therefore, even a person who has a limited chemical knowledge or experience in analysis can perform a mass analysis operation. Furthermore, a highly reliable and reproducible analysis result can be obtained. In addition, since try-and-error operations are omitted in analyzing a mass spectrum, the analysis operation can be more efficient, enhancing the throughput of the analysis.

EXPLANATION OF NUMERALS

1 . . . Liquid Chromatograph (LC) Unit
11 . . . . Mobile Phase Container
12 . . . . Liquid Sending Pump
13 . . . . Injector
14 . . . . Column
2 . . . . Mass Spectrometer (MS) Unit
21 . . . . Ionization Chamber
22 . . . ESI nozzle
23 . . . Desolvation Pipe
24, 27 . . . Intermediate Chamber
25, 28 . . . . Ion Guide
26 . . . . Skimmer
29 . . . . Analysis Chamber
30 . . . . Ion Trap
31 . . . . Time-Of-Flight (TOF) Mass Separator
32 . . . . Reflectron Electrode
33 . . . . Ion Detector
34 . . . . Signal Processor
40 . . . . Data Processor
41 . . . . Mass Spectrum Creator
42 . . . . Deconvolution Processor
43 . . . . Data Memory
50 . . . . Analysis Controller
51 . . . . Central Controller
52 . . . . Control Unit
53 . . . . Display Unit

BEST MODE FOR CARRYING OUT THE INVENTION

An embodiment will be described with reference to the attached figures in which a mass analysis data analyzing apparatus which is an embodied form of the mass analysis data analyzing method according to the present invention is applied to a liquid chromatograph/ion trap time-of-flight mass spectrometer (LC/IT-TOFMS).

Figure 1:
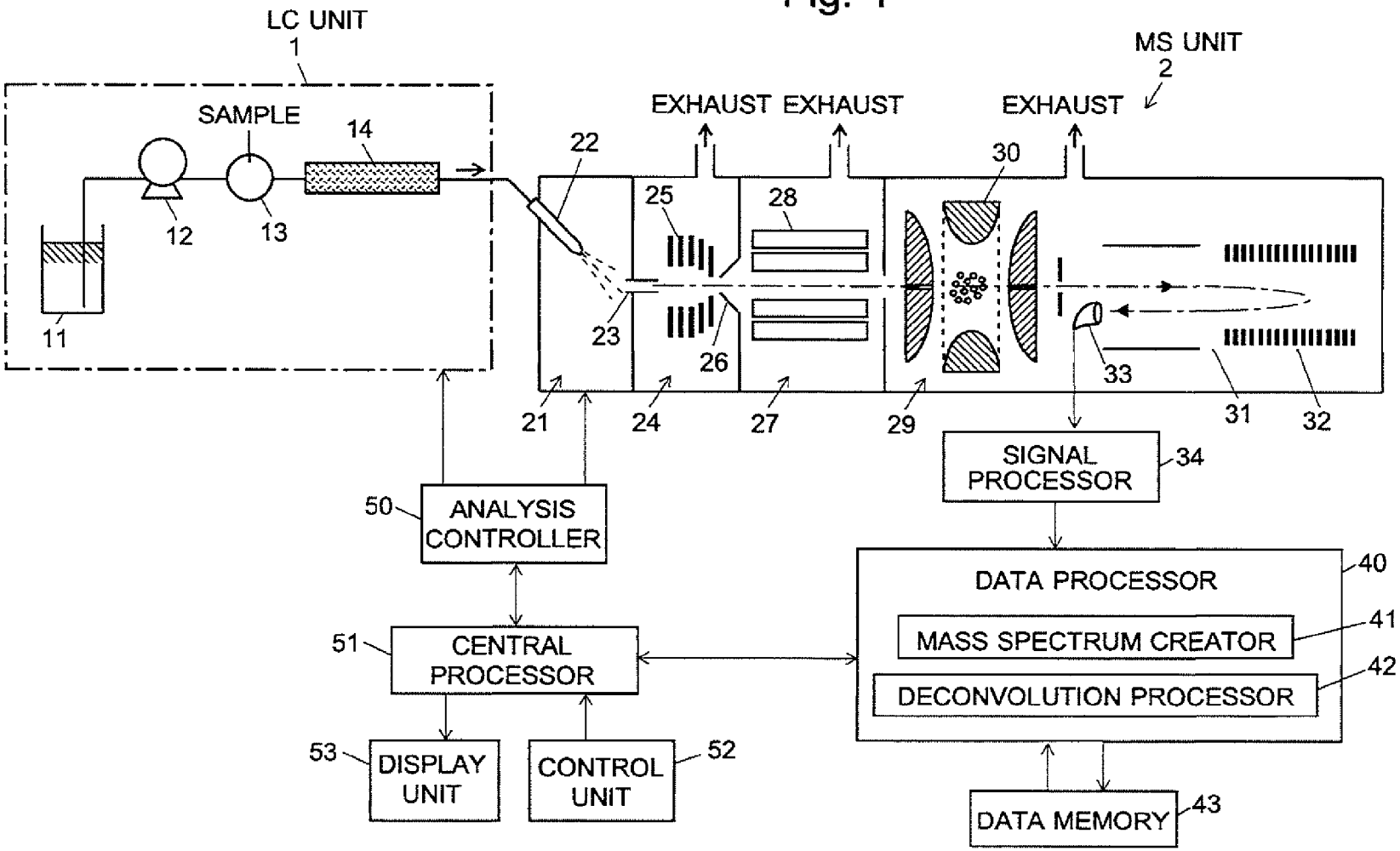
FIG. 1 is a schematic configuration diagram of the main portion of an LC/IT-TOFMS of an embodiment of the present invention.

FIG. 1 is a configuration diagram of the main portion of the LC/IT-TOFMS of the present embodiment. This LC/IT- TOFMS is roughly composed of a liquid chromatograph (LC) unit 1 and a mass spectrometer (MS) unit 2. An electrospray ionization (ESI) interface is used as an atmospheric pressure ionization interface which connects the LC unit 1 and the MS unit 2.

In the liquid chromatograph (LC) unit 1, a liquid sending pump 12 siphons a mobile phase held in a mobile phase container 11, and sends it to a column 14 through an injector 13 at a constant flow rate. Injected by the injector 13, a sample is introduced into the column 14 by the flow of the mobile phase. While passing through the column 14, various components in the sample are separated and eluded from the outlet of the column 14 with time differences. Then, they are introduced to the mass spectrometer (MS) unit 2.

The MS unit 2 has an ionization chamber 21 which is kept in an atmospheric atmosphere, and an analysis chamber 29 which is vacuum-evacuated by a turbo molecular pump (not shown) to be kept in a high vacuum atmosphere. Between these chambers, a first-stage intermediate vacuum chamber 24 and a second-stage intermediate vacuum chamber 27 are provided between which the degree of vacuum is increased in a stepwise manner. The ionization chamber 21 communicates with the first-stage intermediate chamber 24 via a thin desolvation pipe 23, and the first-stage intermediate chamber 24 communicates with the second-stage intermediate chamber 27 via a small-sized orifice bored on top of a conical skimmer 26.

When the elute including the sample components provided from the LC unit 1 reaches an ESI nozzle 22 which serves as an ion source, electric charges are given to the elute by a direct-current high voltage applied by a high-voltage power supply (not shown). Then, it is sprayed into the ionization chamber 21 as charged small droplets. The charged droplets collide with atmospherically derived gas molecules to be broken into smaller droplets, which are promptly dried (or desolvated) and the sample molecules vaporize. The sample molecules are ionized by an ion evaporation. This ESI has a property that multivalent ions, which have a plurality of electric charges, are easily generated in an ionization process. The fine droplets including the generated ions are sucked into the desolvation pipe 23 by the pressure difference, and while they pass through the desolvation pipe 23, the desolvation process further progresses to generate more ions. While being converged by ion guides 25 and 28, the ions pass through two intermediate vacuum chambers 24 and 27 to be sent into the analysis chamber 29. In the analysis chamber 29, the ions are introduced to the inside of a three-dimensional quadrupole ion trap 30.

In the ion trap 30, the ions are temporally captured and stored by a quadrupole electric field formed by a high-frequency voltage which is applied to each electrode from a power source (not shown). At a predetermined timing, a kinetic energy is collectively provided to the variety of ions stored inside the ion trap 30, and the ions are expelled toward a time-of-flight (TOF) mass separator 31, which serves as a mass separator. That is, the ion trap 30 is the starting point of the flight of the ions toward the TOF 31. The TOF 31 has a reflectron electrode 32 to which a direct-current voltage is applied from a direct-current power source (not shown). By the action of the direct-current electric field formed by the reflectron electrode 32, the ions return during their flight and reach an ion detector 33. Although the ions are collectively ejected from the ion trap 30, since ions having smaller mass (m/z, to be exact) fly faster, they reach the ion detector 33 with time differences according to their m/z. The ion detector 33 provides an electric current as a detection signal in accordance with the number of arrived ions.

By a signal processor 34, this detection signal is converted into a voltage signal, converted into a digital value, and then provided to a data processor 40. The data processor 40 includes as its functions a mass spectrum creator 41, a deconvolution processor 42, and other elements. The mass spectrum creator 41 measures the signal intensity of ions every time an ion reach the ion detector 33 from the point in time when the ions have been collectively ejected from the ion trap 30. Then, the mass spectrum creator 41 converts the time information into an m/z value, and creates a mass spectrum in which an m/z value is assigned to the horizontal axis and a signal intensity to the vertical axis. The ejection of ions from the ion trap 30 toward the TOF 31 and the mass separation and detection of the ions in the TOF 31 and the ion detector 33 are repeated at predetermined time intervals, and one mass spectrum is created each time. The deconvolution data which compose the created mass spectrums are stored in a data memory 43, and used for a data analysis process by the deconvolution processor 42 after the mass analysis is finished for example.

Based on the instructions from a central controller 51, an analysis controller 50 controls each element of the LC unit 1 and the MS unit 2 to perform an LC/MS analysis. A control unit 52 and a display unit 53 as a user interface are connected to the central controller 51. In response to a control by an operator through the control unit 52, the central controller 51 provides a variety of instructions for analysis to the analysis controller 50 and the data processor 40, and provides an analysis result such as a mass spectrum to the display unit 53. A portion or most of the functions of the central controller 51, the analysis controller 50, and the data processor 40 can be realized by executing predetermined control/processing software on a personal computer.

As the aforementioned apparatus, in particular, a liquid chromatograph mass spectrometer LCMS-IT-TOF available from Shimadzu Corporation (refer to Shimadzu Corporation's website) for example or other apparatus can be used.

In the aforementioned mass spectrometer, the ESI method is a relatively soft ionization method, and relatively many adduct ions are generated in which a substance in a mobile phase (or solvent), other metal, or other substance is added to the target compound in the liquid sample. For example, for a cation, other than a proton adduct ion in which a proton has been added, an ammonia adduct ion, a sodium adduct ion and other ions tend to be generated. For an anion, other than a proton desorbed ion in which a proton has been desorbed, a chlorine adduct ion, an acetic acid adduct ion, a formic acid adduct ion, and other ions tend to be generated. In this process, a multivalent ion or ions having a plurality of electric charges (negative charges or positive charges) is easily generated. Therefore, peaks of multivalent adduct ions originating from the target compound appear on the mass spectrum. Which adduct ion among these ions appear on the mass spectrum depends on the characteristics of the compound, the kind of the mobile phase, the existence or nonexistence of a contaminant, other analysis conditions, and other factors.

In a conventional mass spectrum analysis process, a user has to enter and set the kind of the added/desorbed component which generates an adduct ion as previously described and other information. On the other hand, in the mass spectrum analysis process performed by the deconvolution processor 42 in the LC/IT-TOFMS of the present embodiment, such an entry and setting by the user are not required.

Figure 2:
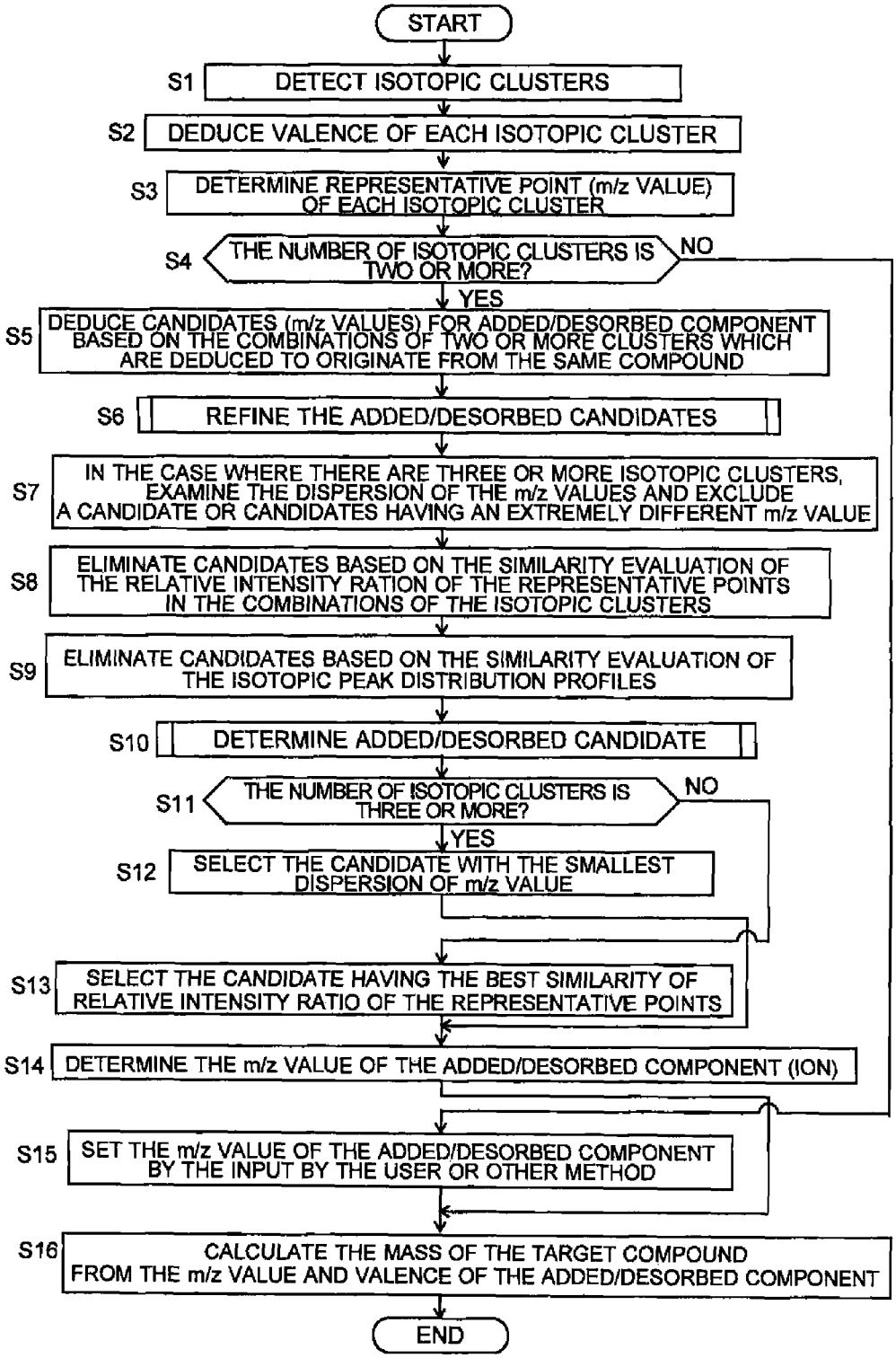
FIG. 2 is a flowchart showing the procedure of the mass spectrum analysis process in the LC/IT-TOFMS of the present embodiment.
Figure 3:
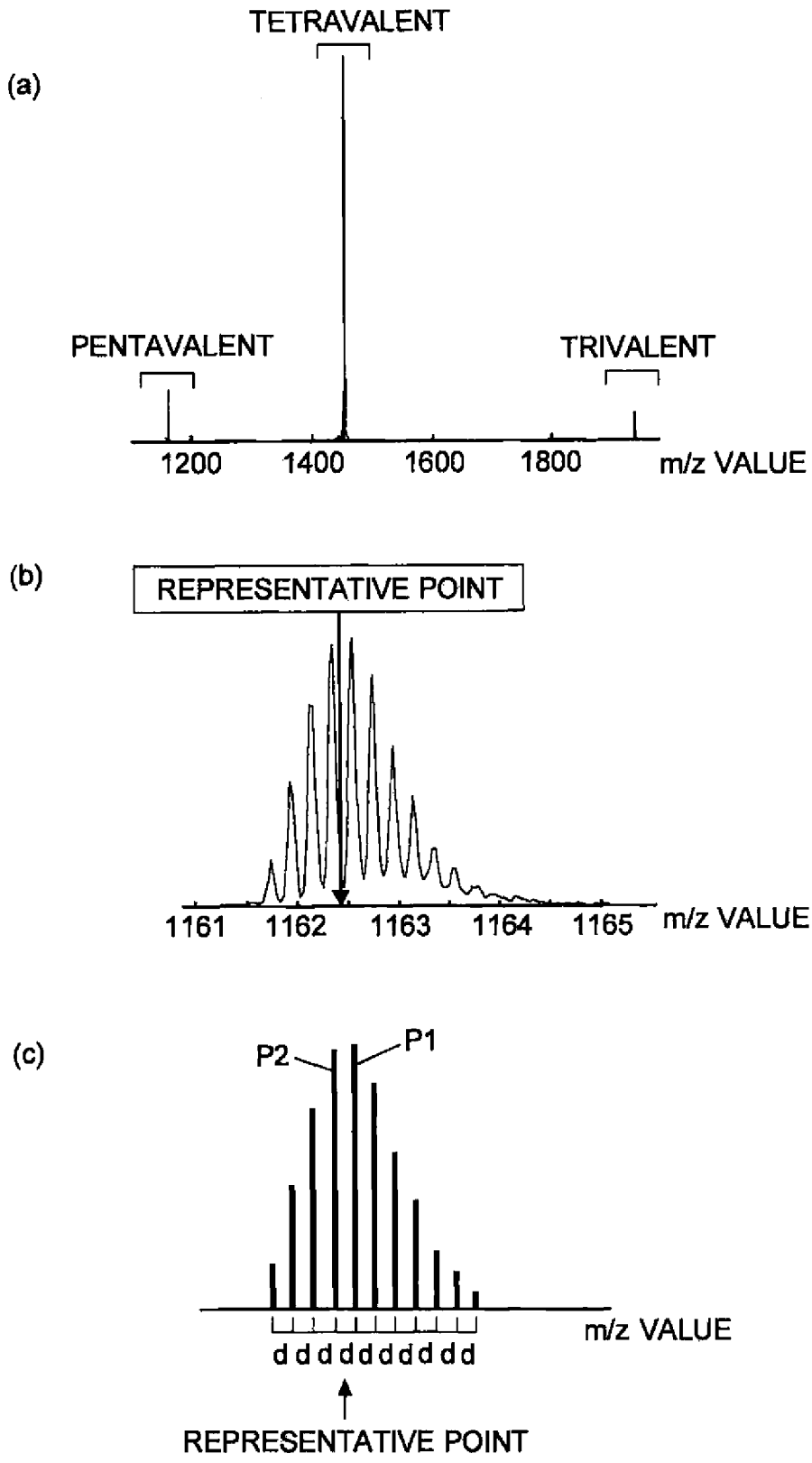
FIG. 3 is a conceptual diagram for explaining the mass spectrum analysis process in the LC/IT-TOFMS of the present embodiment.
Figure 4:
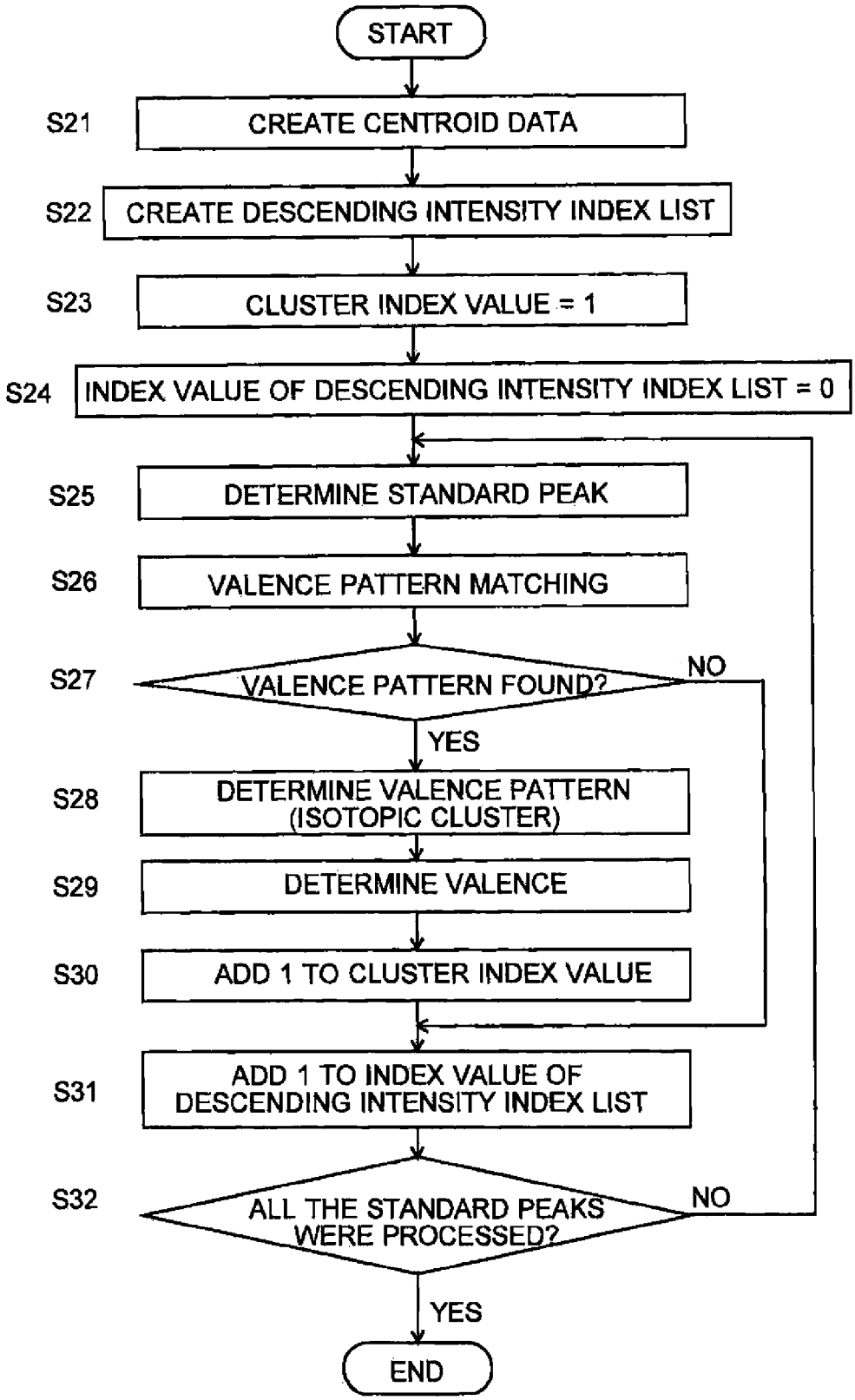
FIG. 4 is a flowchart showing the procedure of detecting isotopic clusters and determining the valence in the mass spectrum analysis process shown in FIG. 2.
Figure 5:
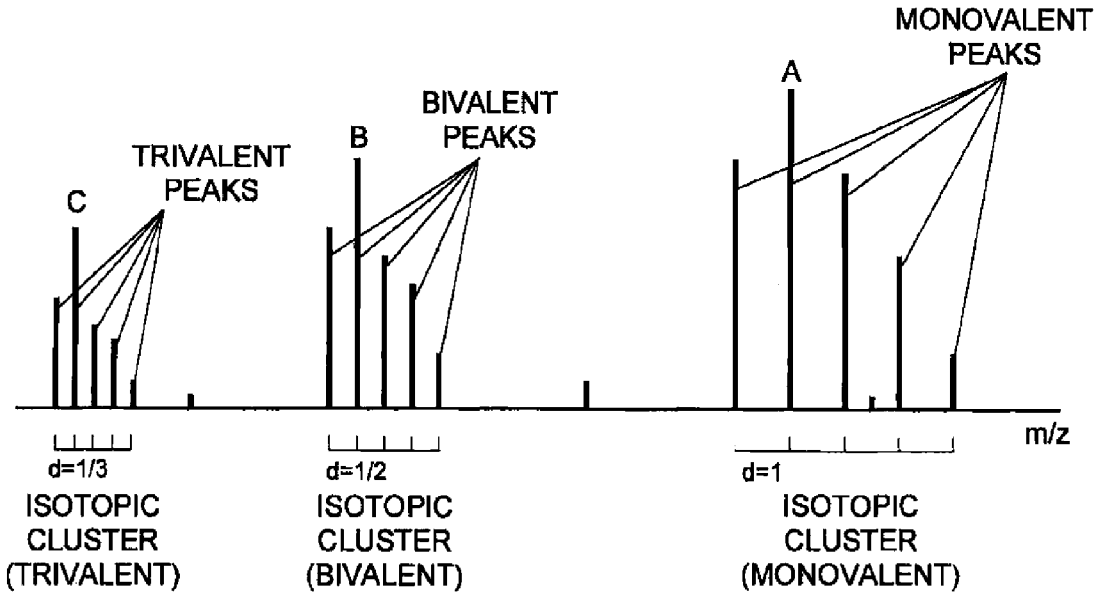
FIG. 5 is a conceptual diagram for explaining how isotopic clusters are detected.

Next, this characterizing mass spectrum analysis process will be described with reference FIGS. 2 through 5. FIG. 2 is a flowchart showing the procedure of the mass spectrum analysis process, FIG. 3 is a conceptual diagram for explaining the mass spectrum analysis process, FIG. 4 is a flowchart showing the procedure of detecting isotopic clusters and determining the valence in the mass spectrum analysis process, and FIG. 5 is a conceptual diagram for explaining how isotopic clusters are detected.

When an analysis process is initiated, the deconvolution processor 42 first detects the isotopic clusters appearing on the mass spectrum to be analyzed, and then obtains the valence n of each isotopic cluster (Steps S1 and S2). An isotopic cluster is a group of peaks which originate from ions having the same element composition and which show different m/z values in accordance with the difference of the isotopic composition in the ions. Practically, one isotopic cluster appears on a mass spectrum as shown in FIG. 3(*b*).

Extracting isotopic clusters requires classifying many peaks appearing on a mass spectrum into groups each belonging to the same isotopic cluster and determining a plurality of peaks composing the isotopic clusters. As a specific example of this method, the method that the applicant of the present invention suggests in the document of International Application No. PCT/JP2006/308909 (International Publication No. WO2006/120928) can be used. The outline of this method will be described with reference to FIGS. 4 and 5.

First, centroid data is created by converting the profile data of a mass spectrum (Step S21). FIG. 3(*c*) shows a result of converting the profile data of FIG. 3(*b*) into centroid data. The centroid data consists of a list of data structures each including the m/z value and intensity of each peak. For an isotopic peak, the data structure also includes the ID number of the isotopic cluster, the valence, and other information. Before the analysis is carried out, the ID number and valence of the isotopic cluster are blank because they are unknown.

So as to access the centroid data in order of the intensity, an index list of each peak (descending intensity index list) is created (Step S22). In the index list, the peaks on the centroid data are listed in the descending order of peak intensity. Then, the ID number of an isotopic cluster to be found from this point and the index value of the descending intensity index list are initialized (Step S23 and S24). After this, on the centroid data, a peak is chosen as a candidate for the standard peak, i.e. a peak that serves as a basis for searching for the pattern of an isotopic cluster (Step S25). In this embodiment, a peak which serves as a standard peak is selected in order of descending peak intensity. The base peak (a peak having the highest intensity among the measured peaks: peak A in FIG. 5) is chosen as the standard peak in the first process. In the processes after the first process, any peak identified as a peak belonging to the isotopic cluster in the previous processes will be kept from being selected as a standard peak.

Next, the peak pattern around the standard peak is analyzed to determine whether or not the peak pattern corresponds to the emerging pattern of the peaks of any of the isotopic clusters having different valence numbers (Step S26). As the parameters for the valence pattern matching, the following values are appropriately set: the range of valence, the tolerance for the mass resolution, the minimum value of the number of peaks consisting an isotopic cluster, and other values.

The valence pattern matching includes the following steps: setting points at even intervals d from the m/z value of the standard peak, the interval d being determined for each isotopic cluster having a different valence number on the assumption that the isotopic cluster includes that standard peak; and checking whether or not a peak exists at each point. For example, if a standard peak is included in a monovalent isotopic cluster, the peaks belonging to the isotopic cluster show a peak pattern with their m/z values different by one valence from each other; therefore the aforementioned interval d is one. If a standard peak is included in a bivalent isotopic cluster, the peaks belonging to the isotopic cluster show a peak pattern with their m/z values different by 0.5 valence from each other; therefore the aforementioned interval d is 0.5. The valence n is obtained by 1/d. Since the valence n must be an integer, if 1/d is not an integer, its value is appropriately rounded to an integer.

In the case where no peak pattern was found which matches as an isotopic cluster around a standard peak in Step S26 (No in Step S27), the processes of the subsequent Steps S28 through 530 are skipped and the process proceeds to Step S31. In the case where two or more isotopic cluster valence patterns have matched the peak pattern around the standard peak, an isotopic cluster valence pattern having the highest matching resolution (or the standard deviation of the difference between the measured value and the predicted value in searching for each peak belonging to an isotopic cluster) is selected to identify the true isotopic cluster (Step S28). If there is only one valence pattern that has matched, that valence pattern is selected as the true isotopic cluster.

After that, the valence of the valence pattern selected in Step S28 is determined as the valence of each peak belonging to the identified isotopic cluster, and the information on the ID number of the cluster, the valence, and other values of each peak belonging to the identified isotopic cluster are reflected as additional information in the aforementioned centroid data (Step S29). Then, the cluster index value and the index value of the descending intensity index list are each incremented (S30 and S31). Then, by determining whether or not the index value of the descending intensity list is equal to or more than the number of the data on the centroid data, whether or not the process for all the standard peaks is terminated is determined (Step S32). If there are unprocessed data, the process returns to Step S25. In this manner, the processes of Steps S25 through S31 are performed to all the peaks in the centroid data.

With these processes, in order of the intensity of peaks on a mass spectrum, a matching process of isotopic clusters around each peak is sequentially performed to determine the valence of the peaks belonging to the identified isotopic cluster. In this manner, isotopic clusters of each valence are separated as shown in FIG. 3(*a*) and FIG. 5.

In calculating the m/z value of the component (or ion) which has been added to or desorbed from a target compound when the target compound is ionized, the m/z value of each isotopic cluster is the key. In the process of this embodiment, in order to speed up the calculation, the representative point is calculated for each of the isotopic clusters, and the m/z value of the representative points is used.

In general, in a mass spectrum obtained by ionizing and mass analyzing a high-molecular compound by using the ESI method or other method, the shape of the peak waveform of an isotopic cluster has a form of slightly-deformed Poisson distribution. Hence, an isotopic cluster has only one peak maximum, and the m/z value that gives this maximum intensity can be used as the representative point. However, if the intensity difference between the highest intensity and the second intensity in an isotopic cluster is small, it is highly likely that these two peaks interchange with each other due to the error in the measurement and a variety of variable factors. Given this factor, in order to improve the reliability, among the plurality of peaks composing an isotopic cluster, the centroid m/z value of the m/z value of the peak that gives the highest intensity (e.g. P1 in FIG. 3(*c*)) and the m/z value of the peak that gives the second highest intensity is calculated, and this m/z value is determined to be the representative point of this isotopic cluster (Step S3).

With the aforementioned process, the valence and the m/z value of the representative point of each isotopic cluster are obtained. By using these values, the m/z value of the ion which has been added to the compound is deduced. However, when the number of isotopic clusters is one, the aforementioned method cannot be applied. Therefore, whether or not the number of isotopic clusters is two or more is determined (Step S4). In the case where the number of isotopic clusters is one, Steps S5 through S14 are skipped and the process proceeds to Step S15.

In the case where the number of isotopic clusters is two or more, the process proceeds to Steps S5 and later. Given that n is the valence of an isotopic cluster, m is the m/z value of the representative point, and Q is the m/z value of the component (or ion) which has been added to the target compound, the mass M of the target compound is obtained by the following expression (1):

$$M=n\times(m-Q) \quad (1)$$

In the case where a component is desorbed from the target compound, this expression can be used with Q having a negative value. Since not so many components are add to or desorbed from the compound in the ionization process, the m/z value Q of the component does not become that large. Accordingly, the range of the value that Q can take can be determined in advance.

Since it can be supposed that the same component is added to or desorbed from the same compound, Q is the same for the same M in the expression (1). If the range of Q is determined as previously described, it is also possible to limit the range of the m/z value in which an isotopic cluster can be regarded to originate from the same compound as other isotopic clusters of different valences (i.e. M in the expression (1) is the same). Hence, from the combinations of two or more isotopic clusters that can be regarded to originate from the same compound, the candidates for the m/z value Q of the added/desorbed component are selected (Step S5). In general, the more the number of isotopic clusters is, the more the number of the combinations of the isotopic clusters that can be regarded to originate from the same compound, and many candidates are selected. It should be noted that, in the case where a plurality of compounds are contained in the sample, the isotopic clusters having different valences and originating from the same compound should be first distinguished and then the aforementioned process is performed.

After a plurality of (generally many) candidates for the m/z value of the added/desorbed component are selected, in order to select one candidate having the highest validity, a refinement operation for eliminating undoubtedly abnormal candidates is performed with the following procedure (Step S6).

In the case where there are three or more isotopic clusters that originate from the same compound (I.e. there are three or more kinds of valences), a plurality of candidates for the m/z value of the added/desorbed component are obtained. As previously described, they are ideally identical. In reality, however, their m/z values are not often identical due to errors in the measurement, incorrect selection of peak as a representative point, and other reasons. If the error is large or the selected peak is incorrect, the candidate m/z value calculated based on them could be far distant from other candidate m/z values. Given this factor, the degrees of dispersion of the plurality of candidate m/z values are examined, and based on the degrees of dispersion, a candidate or candidates having an extremely different m/z value are excluded (Step S7).

If some peaks belonging to isotopic clusters of different valences originate from the same component, the relative intensity of the representative points of these isotopic clusters has a strong correlation. By using this factor, a threshold is set for the similarity of the relative intensity of representative points of different isotopic clusters, and the candidates obtained by combining isotopic clusters having the representative points below the threshold are excluded (Step S8).

Among different isotopic clusters, if the similarity of the distribution profile (or intensity pattern) of a plurality of peaks composing an isotopic cluster is high, the reliability of the candidate is probably high. By using this factor, the candidates obtained by combining isotopic clusters having a small similarity of the distribution profiles of peaks can be excluded (Step S9). In particular, an index value such as a correlation coefficient of the peak distribution profiles among different isotopic clusters may be obtained and by using this value, candidates having a low correlativity may be excluded. However, an easier method is used in this embodiment.

As previously described, the position (or ink value) of the representative point of each isotopic cluster is the centroid point between the position which gives the highest intensity and the position which gives the second highest intensity. Therefore, the positional relationship and the intensity ratio between the highest intensity point and the second highest intensity point are reflected to the position of the centroid point. Given this factor, candidates obtained based on an isotopic cluster are excluded in which the positional relationship among the representative point, the highest intensity point, and the second highest intensity point is significantly deformed. Practically this excludes the candidates obtained based on the combination of isotopic clusters whose peak distribution profiles are significantly different.

The number of candidates is decreased by performing the three-step refinement as previously described. The order of performing Steps S7-S9 carries no special significance and they can be interchanged. After that, one candidate having the highest validity is finally selected (Step S10). First, whether or not the number of isotopic clusters is three or more is checked (Step S11). In the case of three or more, the candidate with the best condition according to the selection criteria of Step S7 is selected. That is, among a plurality of candidates, the candidate with which the degree of dispersion is the smallest is selected (Step S12).

In the case where the number of isotopic clusters is less than three (in practice, in the case of two) in Step S11, the candidate with the best condition according to the selection criteria of Step S8 is selected. That is, the combination of the isotopic clusters in which the similarity of the relative intensities of the representative points are the highest is found for each isotopic cluster, and the candidate obtained by that combination is selected (Step S13).

As a result of Step S12 or S13, the m/z value Q of the component is determined which has been added to or desorbed from the compound when the compound was ionized (Step S14). In the meantime, in the case where the determination of Step S4 is No, that is, in the case where no multivalent ion is generated and only one isotopic cluster is present, the m/z/value of the added/desorbed component cannot be obtained by the aforementioned method. In such a case, the added/desorbed component is determined by another method, such as asking a user to specify a deduced added/desorbed component (Step S15). When the m/z value of the added/desorbed component is obtained in this manner, the mass of the target compound is calculated based on the aforementioned expression (1), and the calculation result is provided to the display unit 52 or other devices (Step S16).

As described thus far, with this mass spectrum analysis process, the component which has been added to or desorbed from the target compound in an ionization process is automatically specified based on a mass spectrum on which peaks by a multivalent ion or ions appear, and by using this result, the mass of the target compound can be obtained. Since this can save a person in charge of analysis from deducing the component which is added to or desorbed from the component, even a person having a limited chemical knowledge or experience required for such a deduction can perform an analysis operation.

It should be noted that the embodiment described thus far is merely an example of the present invention, and it is evident that any modification, adjustment, or addition made within the sprit of the present invention is also included in the scope of the claims of the present application.

The invention claimed is:

1. A mass analysis data analyzing method for obtaining a mass of a target compound by analyzing data of a mass spectrum obtained by a mass analysis on which peaks of a multivalent ion appear, comprising:

obtaining a mass spectrum by a mass analysis apparatus;

detecting isotopic clusters on the mass spectrum and for deducing a valence of each of the isotopic clusters;

obtaining an m/z value which represents each of the detected isotopic clusters;

obtaining candidates for an m/z value of a component which has been added to the target compound or desorbed from the target compound in an ionization process, based on a combination of representative points and valences of two or more isotopic clusters which are deduced to originate from a same target compound;

evaluating, for the plurality of candidates obtained from different combinations of the plurality of isotopic clusters, a validity of a combination of the candidate m/z values or the isotopic clusters which were a basis of a calculation of the m/z values to finally select one candidate; and deducing the mass of the target compound based on the m/z value and the valence of the selected added/desorbed component.

2. The mass analysis data analyzing method according to claim 1, wherein in the evaluation step, one or more candidates are selected or excluded by applying a statistical method to the plurality of candidate m/z values.

3. The mass analysis data analyzing method according to claim 2, wherein in the evaluation step, the one or more candidates are excluded by evaluating a variance of the plurality of candidate m/z values.

4. The mass analysis data analyzing method according to claim 1, wherein in the evaluation step, one or more candidates are selected or excluded by evaluating intensity ratios of the representative points or peaks of different valences.

5. The mass analysis data analyzing method according to claim 1 wherein in the evaluation step, one or more candidates are selected or excluded by evaluating, for different isotopic clusters, a similarity of pattern shapes of entire or a portion of the plurality of peaks which compose those isotopic clusters, the similarity being a correlation coefficient of the peak distribution profiles.

6. The mass analysis data analyzing method according to claim 1, wherein in the obtaining an m/z value step, an m/z value of a centroid of a plurality of peaks near a peak having a highest intensity in an isotopic cluster is set to be a representative point.

7. A mass analysis data analyzing apparatus for obtaining a mass of a target compound by analyzing data of a mass spectrum obtained by a mass analysis on which peaks of a multivalent ion appear, comprising:

a mass spectrometer unit for obtaining a mass spectrum, a valence deductor for detecting isotopic clusters on the mass spectrum and for deducing a valence of each of the isotopic clusters;

a representative point determinator for obtaining an m/z value which represents each of the detected isotopic cluster;

a candidate extractor for obtaining candidates for an m/z value of a component which has been added to the target compound or desorbed from the target compound in an ionization process, based on a combination of representative points and valences of two or more isotopic clusters which are deduced to originate from a same target compound;

an added/desorbed component selector for evaluating, for the plurality of candidates obtained from different combinations of the plurality of isotopic clusters, a validity of a combination of the candidate m/z values or the isotopic clusters which were a basis of a calculation of the m/z values to finally select one candidate; and a compound deductor for deducing the mass of the target compound based on the m/z value and the valence of the selected added/desorbed component.

8. The mass analysis data analyzing apparatus according to claim 7, wherein the added/desorbed component selector selects or excludes one or more candidates by applying a statistical method to the plurality of candidate m/z values.

9. The mass analysis data analyzing apparatus according to claim 8, wherein the added/desorbed component selector selects or excludes the one or more candidates by evaluating a variance of the plurality of candidate m/z values.

10. The mass analysis data analyzing apparatus according to claim 7, wherein the added/desorbed component selector selects or excludes one or more candidates by evaluating intensity ratios of peaks of the representative points or peaks of different valences.

11. The mass analysis data analyzing apparatus according to claim 7, wherein the added/desorbed component selector selects or excludes one or more candidates by evaluating, for different isotopic clusters, a similarity of pattern shapes of entire or a portion of the plurality of peaks which compose those isotopic clusters, the similarity being a correlation coefficient of the peak distribution profiles.

* * * * *